United States Patent [19]

Cartwright

[11] Patent Number: 4,920,743

[45] Date of Patent: May 1, 1990

[54] CRASH BAG PROPELLANT COMPOSITION AND METHOD FOR GENERATING NITROGEN GAS

[75] Inventor: Richard V. Cartwright, Sussex, N.J.

[73] Assignee: Hercules Incorporated, Wilmington, Del.

[21] Appl. No.: 223,965

[22] Filed: Jul. 25, 1988

[51] Int. Cl.[5] ..... C06D 5/00; C06B 45/10

[52] U.S. Cl. ..... 60/205; 149/19.1; 149/35; 280/741

[58] Field of Search ..... 148/19.1, 35; 60/205; 280/741

[56] References Cited

U.S. PATENT DOCUMENTS

| | | | |
|---|---|---|---|
| 2,981,616 | 4/1961 | Boyer | 149/35 |
| 3,741,585 | 6/1973 | Hendrickson et al. | 149/35 |
| 3,779,823 | 12/1973 | Price et al. | 149/35 |
| 3,797,854 | 3/1974 | Poole et al. | 149/35 |
| 3,865,660 | 2/1975 | Lundstrom | 149/35 |
| 3,883,373 | 5/1975 | Sidebottom | 149/35 |
| 3,895,098 | 7/1975 | Pietz | 149/35 |
| 3,904,221 | 9/1975 | Shiki et al. | 149/35 |
| 3,912,561 | 10/1975 | Doin et al. | 149/35 |
| 3,920,575 | 11/1975 | Shiki et al. | 149/35 |
| 3,931,040 | 1/1976 | Breazeale | 149/35 |
| 3,936,330 | 2/1976 | Dergazarian et al. | 149/35 |
| 3,942,300 | 3/1976 | Passauer et al. | 149/35 |
| 3,977,924 | 8/1976 | McCulloch et al. | 149/35 |
| 4,005,876 | 2/1977 | Jorgensen et al. | 149/35 |
| 4,021,275 | 5/1977 | Kishi et al. | 149/35 |
| 4,062,708 | 12/1977 | Goetz | 149/35 |
| 4,094,028 | 6/1978 | Fujiyama et al. | 149/35 |
| 4,157,648 | 6/1979 | Brennan et al. | 149/35 |
| 4,203,787 | 5/1980 | Kirchoff et al. | 149/35 |
| 4,214,438 | 7/1980 | Hamilton et al. | 149/35 |
| 4,243,443 | 1/1980 | Utracki | 149/35 |
| 4,376,002 | 3/1983 | Utracki | 149/35 |
| 4,390,380 | 6/1985 | Camp | 149/35 |
| 4,533,416 | 8/1985 | Poole | 149/35 |
| 4,547,235 | 10/1985 | Schneiter et al. | 149/35 |
| 4,604,151 | 8/1986 | Knowlton et al. | 149/35 |
| 4,734,141 | 3/1988 | Cartwright et al. | 149/35 |

*Primary Examiner*—Edward A. Miller

*Attorney, Agent, or Firm*—John E. Crowe

[57] ABSTRACT

A propellant composition and method for limiting the corrosive properties of by-products from initiated crash bag propellant compositions comprising a 1(a) or 2(a) group metal azide salt, an oxidizer in the form of an oxide of a non-toxic transition metal element, and an effective amount of a modifier component of the formula $$Me_x(An)_o$$

wherein

Me is a metal cation selected from iron, copper, cobalt, nickel, and molybdenum;

An is an anion group which is chemically compatible with and capable of reacting with the metal of the azide salt to form nitrogen gas and non-toxic by-products less corrosive than the corresponding hydroxide of the azide metal would be; and x and o are individually defined as positive numbers appropriate to indicate the correct chemical formula.

11 Claims, No Drawings

CRASH BAG PROPELLANT COMPOSITION AND METHOD FOR GENERATING NITROGEN GAS

The present invention related to a gas-generating propellant composition and a process capable of producing high quality inert non toxic gas for use in a crash bag while minimizing production of corrosive or potentially corrosive metal oxide by-product.

BACKGROUND

In general, the use of inflatable crash bags for protecting drivers and passengers involved in vehicular accidents is widely known.

In early versions of such devices, a compressed gas such as air, carbon dioxide, or nitrogen was stored, in situ, in a pressure bottle or flask, the valving of which was activated by sensing means responsive to rapid change in velocity or direct impact.

Generally speaking, such devices have been found unsatisfactory because of slow crash bag-inflation rates and the problem and expense of maintaining a pressure bottle or flask at the required pressure level over an indefinite period of time.

As a result, stored gas systems have now been generally replaced by gas-generating propellant compositions, particularly exothermic gas-generating propellants.

A system of the latter type, however, must have a relatively short reaction time (10–60 milliseconds) to achieve the desired degree of bag inflation. In addition, it is very important that (a) the generated gas and reaction by products be essentially non toxic and non-corrosive; (b) the underlying exothermic reaction occur at a controlled rate to avoid generation of excessive heat capable of burning the passenger or weakening the crash bag; (c) the propellant composition retain both stability and reactivity for relatively long periods of time under at least normal driving conditions, including a wide range of ambient temperatures and shock; and (d) the amount of propellant, its packaging, and the bag itself must be very compact, light and storable within a steering column and/or dash panel.

Gas-generating crash bag propellant compositions known to the art include, for instance, an alkali metal azide combined with an alkali metal oxidant, together with an amide or tetrazole (U.S. Pat. No. 3,912,561); silicon dioxide with an alkali or alkaline earth metal plus a nitrite or perchlorate (U.S. Pat. No. 4,021,275); an alkali metal azide with a metal halide (U.S. Pat. No.. 4,157,648 ; a plurality of metal azides with metal sulfides, metal oxides and sulfur (U.S. Pat. No. 3,741,585); an alkali earth metal plus an azide with a peroxide, perchlorate or nitrate (U.S. Pat. No. 3,883,373); an alkali metal azide with a metal oxide (iron, titanium or copper) (U.S. Pat. No. 3,895,098); an alkali metal-or alkaline earth metal-azide with an oxidant consisting of iron oxide doped with up to 1 wt. % of nickel or cobalt oxide (U.S. Pat. No. 4,376,002); and an alkali-or alkaline earth metal-azide combined with an oxidant obtained by forming a hydrated gel of a suitable base and metal salt, which is thereafter dehydrated in the presence of a metal oxide of aluminum, magnesium, chromium, manganese, iron, cobalt, copper, nickel, cerium and various transition series elements (U.S. Pat. No. 4,533,416).

Generally, the most frequently used crash bag propellants contain an azide salt capable of producing nitrogen gas when reacted with an oxidizer component. Typical of such reactions are the following:

$$2NaN_3 + CuO \rightarrow 3N_2 + Cu + Na_2O \quad [1]$$

$$6NaN_3 + Fe_2O_3 \rightarrow 9N_2 + 2Fe + 3Na_2O \quad [2]$$

in which elemental copper or iron and sodium oxide ($Na_2O$) are obtained as by-products.

While copper and iron have little toxicity in their elemental forms, $Na_2O$ and similar alkali and alkaline earth metal oxides are potentially corrosive and/or toxic, owing to their caustic effect on tissue. In particular, nitrogen gas obtained by reacting metal azides and oxidizers, as above described, may additionally contain a substantial amount of alkali metal oxide by-product and corresponding hydroxides within readily breathed dust and aerosols.

It is an object of the present invention to obtain a safe alkali metal azide/oxidizer-type propellant composition capable of rapidly and consistently producing high quality nitrogen gas suitable for crash bag systems.

It is a further object to reduce corrosive properties of by-products generated by initiating the reaction of a crash bag propellant comprising a group 1(a)- or 2(a)-type metal azide component and an oxidizer component.

THE INVENTION

The above objects, and particularly the reduction of corrosive properties of by-products generated by initiating the reaction of a crash bag propellant composition comprising group 1(a)- or 2(a)-type metal azide component and an oxidizer component, particularly an oxide of a transition metal, are obtained by replacing the oxidizer component, at least in part, with an effective amount of a modifier component as hereafter defined.

A propellant composition within the scope of the present invention comprises in combination, the following components:

(a) a metal azide salt component of a group 1(a)- or 2(a)-type metal inclusive of alkali or alkaline earth metals such as a sodium-, potassium- or calcium-azide;

(b) an oxide of a non-toxic transition metal element in an amount sufficient to react up to about 70% and preferably up to about 30% of the available metal azide salt component; and (c) an effective amount of a modifier component represented by the formula $$Me_xAn_o$$

wherein Me is defined as a cation of a non-toxic transition metal element, such as iron, copper, cobalt, nickel and molybdenum;

An is defined as an anion group which is chemically compatible with the transition metal cation (Me) of the modifier component and capable of reacting with the metal azide salt component to obtain non-toxic by-products less basic than a metal hydroxide corresponding to the metal azide salt component. Such anion groups can include, for instance, —$[(OH)_2CO_3]^{-4}$, —$(CO_3)^{-2}$, —$(PO_4)^{-3}$, —$(HPO_3)^{-2}$ —$[HPO_4)^{-2}$, —$(P_2O_7)^{-4}$, —$(SiO_4{-}^{4}$, —$(BO_3)^{-3}$ —$(B_4O_7)^{-2}$, —$(B_2O_5)^{-4}$, —$(SO_4{-}^{3}$, —$(SO_3)^{-2}$ —$(S_2O_7)^{-2}$, —$(HSO_4)^{-1}$, $Cl^-$, —$F^-$, —$Br^-$ $I^-$, and the like; and x and o are individually defined as positive numbers appropriate to indicate the correct chemical formula.

The term "effective amount of a modifier" as used herein denotes the amount required to fully react with from about 30% up to about 100% by weight of the available group 1(a) or 2(a) group metal azide component of the propellant composition. The resulting competing or modifying reaction attributed to the modifier component is conveniently represented by the following equations [3-7], using sodium azide as a typical group 1(a) metal azide component:

$$NaN_3 + MeAn \rightarrow NaAn + 3/2\ N_2 + Me \quad [3]$$

$$6NaN_3 + Cu_3(PO_4)_2 \rightarrow 9N_2 + 2Na_3PO_4 + 3\ Cu \quad [4]$$

$$4NaN_3 + Cu_2(OH)_2CO_3 \rightarrow 6N_2 + 2NaOH + NaCO_3 + Cu \quad [5]$$

$$2NaN_3 + FeCO_3 \rightarrow 3N_2 + Na_2CO_3 + Fe \quad [6]$$

$$3NaN_3 + FePO_4 \rightarrow 9/2\ N_2 + Na_3PO_4 + Fe. \quad [7]$$

For purposes of the present invention the combined amount of (b) oxide and (c) modifier components can generally total at least a stoichiometric amount or greater, relative to available (a) azide component of the propellant composition, and the ratio of (b) oxide-to- (c) modifier component can be conveniently varied to obtain an acceptable level of metal oxide (or hydroxide) by-Product and also to assure substantial completion of the reaction of the azide component and a buildup of nitrogen gas pressure within a normally allotted period of about 10-60 milliseconds.

Depending upon the amount and choice of azide component(s) used, the hardware employed, including crash bag volume and design, and the safety standards currently in effect, the above parameters can be varied substantially without loss of functionality.

Also includible within propellant compositions of the present invention, are additives commonly used in the tabletting art, which can be added separately or in combination, such as (1) binders (both inorganic and organic), exemplified by microcrystalline cellulose, dicalcium phosphate, polyvinyl pyrrolidone and the like, the choice and amount of such additive generally favoring avoidance or minimizing production of carbon monoxide. For this reason organic additives of this type generally do not exceed about 5% by weight of the propellant composition;

(2) lubricants such as magnesium stearate, calcium stearate and aluminum stearate (0.1-1.0%) can be included for ease in tabletting;

(3) water proofing materials such as dilute solutions of ethyl cellulose, cellulose acetate or nitrocellulose are found useful for protecting the generally hygroscopic azide propellant component; and (4) burn rate enchancers such as ammonium perchlorate, $MnO_2$, $Fe_2O_3$ and NiO (0.05-1.0 wt. %); and the like.

The use of propellants in the form of pellets or tablets is found particularly useful in order to minimize separation out of propellant components induced by shock or vibration over a period of time, and, such form also, assures a more predictable speed of reaction, plus long term control over the amount of heat generated per unit of time.

Particularly preferred propellant compositions of the present invention can contain [a]weight % ranges of (a) metal azide, (b) oxidant, and (c) modifier component from about (a) 40%-73%, (b) 0%-25% and (c) 10%-60% and, preferably about 40%-73%, 0-10%, and 27%-60% respectively. The balance (usually 10% or less) can comprise one or more of the above-listed or other known propellant additives such as binders, lubricants, water proofing material, and the like.

The manufacture of propellant compositions of the instant invention can be conveniently carried out by wet or dry granulation of the components, admixed with binders, lubricants and the like, then compressed into tablets or pellets in the usual art-recognized manner. Background information concerning suitable techniques for producing pelleted and granulated propellant compositions can be found, for instance, in U.S. Pat. Nos. 3,996,079 and 4,376,002.

Gas generating units, means for ignition, and sensing devices suitable for use with propellant compositions of the present invention are described, for instance, in U.S. Pat. Nos. 3,450,414 (Kobori et al), 3,904,221 (Shiki et al), 3,741,585 (Hendrickson), and 4,094,028 (Fujiyama et al).

The instant invention is further illustrated but not limited in the following Examples and Tables.

EXAMPLE I

A. 27.8 grams of dry powdered sodium azide*1 and 31.9 grams of reagent grade copper (II) phosphate $[Cu_3(PO_4)_2]$*2 are thoroughly admixed, wetted to a sticky consistency with water, oven dried for 24 hours at 55° C., and thereafter dried for 24 hours at 25° C. The material is broken up by pushing the resulting agglomerates through an 8 mesh screen, and the fines shaken out using a 20 mesh screen to obtain granulated propellant identified as S-1.

A 180 cc closed test bomb is charged with 11 grams of S-1 granulated propellant and 0.6 gram of a commercially obtained granular igniter powder*3 and the reaction initiated in the usual art recognized manner, using an electric match. The bomb test is repeated and the resulting test data processed, using a Norland 3001 wave form analyze (Pressure vs. Time in 0.001 sec intervals) to determine peak Pressure (P) and quickness (Q) of the gas generating reaction. The solid residue from each test shot is then extracted with distilled water, filtered and uniformly diluted to obtain 0.2% by weight of dissolved solids, and then tested with a pH meter, and the results reported in Table I.

B. 31.7 grams of dry powdered sodium azide*1 and 28.0 grams of reagent grade copper (II) carbonate [$Cu_2(OH)_2CO_3$]*4 are thoroughly admixed, wetted, dried, and granulated and screened as in Example IA. Eleven grams of the resulting granular propellant sample, identified as S-2, and 0.6 gram of commercial granular igniter powder*3 are then packed into the same type 180 cc closed test bomb and the reaction initiated as before. Test data from replicate runs is analyzed, and reported in Table 1.

C. A control, identified as C-1, is run in the manner of Examples IA. and IB. supra, using 37.2 grams of granulated sodium azide*1 and 22.8 grams of copper (II) oxide*5 together with the same weight of propellant and igniter powder used in IA. The resulting test data is analyzed as before and reported in Table I.

D. 31.7 grams of dry powdered sodium azide*1 and 28.3 grams of reagent grade iron (II) carbonate ($FeCO_3$) are thoroughly admixed, wetted, dried and granulated as in IA., supra, and 11 grams of the resulting granular sample propellant S-3), plus 0.6 gram granular igniter powder*3 are packed into the same type 180 cc closed test bomb as before and ignited. The test data for replicate runs are analyzed as before and reported in Table I.

E. 33.8 grams of dry powdered sodium azide*1 and 26.2 grams of reagent grade iron (III) phosphate ($FePO_4$)*6 are thoroughly admixed, wetted, dried and granulated as in IA., and 11 grams of the resulting granular sample (S-4), plus 0.6 gram of granular igniter powder*3 are packed into the same type 180 cc closed bomb, ignited and the test data analyzed as before and reported in Table I.

F. 42.6 grams of dry powdered sodium azide*1 and 17.4 grams of pigment grade iron (III) oxide ($Fe_2O_3$)*7 are admixed, wetted, dried, and granulated as before, and 11 grams of the resulting control (C-2) plus 0.6 gram granular igniter powder*1 are packed into the same type 180 cc closed test bomb and reacted. The test results are processed as before and reported in Table I.

EXAMPLE II

Example I is repeated, using tabletted propellant*10 containing 8% by weight of microcrystalline cellulose as binder and 0.5% by weight magnesium stearate as lubricant to obtain results comparable to that obtained with S-1 with respect to pressure generation, quickness and a significantly lowered $OH^-$ concentration in the diluted extract, compared with a similarly tabletted control sample.

*1 Obtained from Charkit Chemical Corporation, Darien, CT.
*2 Obtained from Pfaltz & Bauer Div. of Aceto Chemical Co., Waterbury, CT.
*3 Consisting of 69.7% of $KNO_3$, 24.5% Boron and, 5.8% Laminac binder; IP-10 powder from Tracor MB-Associates, East Camden, AR.
*4 Obtained from Aldrich Chemical Co., Inc., Milwaukee, WI.
*5 Obtained from CP Chemicals Inc. of Sewaren, NJ.
*6 Obtained from Strem Chemicals, Inc. of Newburyport, MA.
*7 Obtained from Pfizer Minerals, Pigments & Metals Div., New York, NY.
*10 0.25" diameter (0.09–0.11 gm) tablets produced by a Stokes Model A-3 Tabletting machine.

EXAMPLE III

Example I is repeated using potassium azide as the (a) azide propellant component, test results offering comparable advantages over the corresponding control (C-1) with respect to pressure generating, quickness and lowered $OH^-$ concentration in the diluted extract.

EXAMPLE IV

Example 1 is repeated, using (a) sodium azide (52.4 gm), (b) iron (III) oxide (16.3 gm) and (c) iron (II) carbonate (11.3 gm) admixed and granulated as before, and 11 grams thereof combined with 0.6 gm igniter powder and packed, as before, into a 180 cc closed test bomb. The reaction is initiated and test results analyzed and reported in Table II below as S-5.

EXAMPLE V

Example I is repeated using (a) sodium azide (46.6 gm), (b) iron (III) oxide (7 gm), and (c) iron (II) carbonate (26.4gm), admixed, granulated, and 11 grams thereof combined with 0.6 gm igniter powder and packed as before into a 180cc closed test bomb. The reaction is initiated and test results are analyzed and reported in Table II below as S-6.

TABLE I

| Sample | Oxidant/Modifier | Number of shots fired | $[OH^-]$ in diluted extract, millimolar | $P/P_o$*8 | $Q/Q_o$*9 |
|---|---|---|---|---|---|
| S-1 | Copper(II) phosphate | 3 | 2.6 | 0.83 | 0.58 |
| S-2 | Basic copper (II) carbonate | 2 | 6.5 | 1.08 | 1.40 |
| C-1 | Copper (II) oxide (control) | 3 | 10.2 | 1.0 | 1.0 |
| S-3 | Iron (II) carbonate | 3 | 1.5 | 1.16 | 3.67 |
| S-4 | Iron (III) phosphate | 3 | 4.6 | 1.58 | 16.7 |
| C-2 | Iron (III) oxide (control) | 2 | 8.3 | 1.0 | 1.0 |

*8P = peak pressure generated within 400 milliseconds of ignition with test propellant; $P_o$ = peak pressure from control propellant made with the corresponding oxide.

*9Q = quickness of test propellant; $Q_o$ = quickness of propellant made with the corresponding oxide. Quickness is the area under the curve of dp/dt (rate of pressure increase) vs. p (pressure) between 25% and 70% of peak pressure.

TABLE II

| Sample | # Shots | (a) gm | (b) gm | (c) gm | $OH^-$(*10) Millimolar | $P/P_o$*8 | $Q/Q_o$*9 |
|---|---|---|---|---|---|---|---|
| S-5 | 3 | 52.4 | 16.3 | 11.3 | 13.2 | 1.31 | 5.02 |

TABLE II-continued

| Sample | # Shots | (a) gm | (b) gm | (c) gm | $OH^{-}$(*10) Millimolar | $P/P_o$*8 | $Q/Q_o$*9 |
|---|---|---|---|---|---|---|---|
| S-6 | 3 | 46.6 | 7.0 | 26.4 | 5.8 | 1.25 | 3.78 |

*8P = peak pressure generated within 400 milliseconds of ignition with test propellant; $P_o$ = peak pressure from control propellant made with the corresponding oxide.
*9Q - quickness of test propellant; $Q_0$ = quickness of propellant made with the corresponding oxide. Quickness is the area under the curve of dp/dt (rate of pressure increase) vs. p (pressure) between 25% and 70% of peak pressure.
*10 In diluted extract.

What I claim and desire to protect by Letters Patent is:

1. A crash bag propellant composition comprising, in combination,
   (a) a metal azide salt component of a group 1(a)- or 2(a)-type metal; and
   (b) an oxide of a non-toxic transition metal element sufficient to react with up to about 70% of said metal azide salt component; and
   (c) an effective amount of a modifier component represented by the formula $$Me_x(An)_o$$

wherein
Me is defined as a cation of iron or copper;
An is defined as phosphorus containing anion group which is chemically compatible with Me and capable of reacting with said metal azide salt component to obtain non-toxic by-products less basic than a metal hydroxide corresponding to said metal azide salt component; and
x is defined as a positive number of about 1–4; and
o is defined as a positive number not exceeding about 3, the sum of which does not exceed about 7.

2. A propellant composition of claim 1, in which Me is defined as copper; An is defined as a $—(PO_4)^{-3}$ group; x is a positive number of about 3; and o is a positive number of about 2.

3. A propellant composition of claim 1, in which Me is defined as iron; An is defined as $—(PO_4)^{-3}$ group; x is a positive number of about 1; and o is a positive number of about 1.

4. A propellant composition of claim 1 wherein the metal azide is sodium azide or potassium azide.

5. A propellant composition of claim 1, comprising at least one of a binder and a lubricant.

6. A propellant composition of claim 4, comprising at least one of a binder and a lubricant.

7. A propellant composition of claim 2, comprising at least one of a binder and a lubricant.

8. A propellant composition of claim 3, comprising at least one of a binder and a lubricant.

9. A method for reducing corrosive properties of by-products generated by initiating the reaction of a crash bag propellant composition comprising a group 1(a)- or 2(a)-type metal azide component and an oxide of a transition metal as an oxidizer component, comprising replacing said oxidizer component, at least in part, with an effective amount of a modifier component of the formula $$Me_xAn_o$$

wherein
Me is defined as a cation of a non-toxic iron or copper metal element;
An is defined as phosphorus containing anion group which is chemically compatible with said transition metal cation of said modifier component, and capable of reacting with said metal azide salt component to obtain non-toxic by-products less basic than a metal hydroxide corresponding to said metal azide salt component;
x is defined as a positive number of about 1–4; and
o is defined as positive number not exceeding about 3, the sum of which does not exceed about 7.

10. A method of claim 9, in which Me is defined as copper; An is defined as a $—(PO_4)^{-3}$ group; x is a positive number of about 3; and o is a positive number of about 2.

11. A method of claim 9, in which Me is defined as iron; An is defined as a $—(PO_4)^{-3}$ group; x is a positive number of about 1; and o is a positive number of about 1.

* * * * *

UNITED STATES PATENT AND TRADEMARK OFFICE

CERTIFICATE OF CORRECTION

PATENT NO. : 4,920,743

DATED : MAY 1, 1990

INVENTOR(S) : CARTWRIGHT

It is certified that error appears in the above-identified patent and that said Letters Patent is hereby corrected as shown below:

Column 3, Line 6

"$-(SiO_4{}^{-4}$," should read -- $-(SiO_4)^{-4}$, --

Column 3, Lines 6,7

"$-(SO_4{}^{-3}$," should read -- $-(SO_4)^{-2}$,--

Column 3, Line 27

"$NaCO_3$ + Cu" should read -- $Na_2CO_3$ + 2Cu --

Column 4, Line 64

"analyze" should read -- analyzer --

UNITED STATES PATENT AND TRADEMARK OFFICE

CERTIFICATE OF CORRECTION

PATENT NO. : 4,920,743

DATED : MAY 1, 1990

INVENTOR(S) : CARTWRIGHT

It is certified that error appears in the above-identified patent and that said Letters Patent is hereby corrected as shown below:

Column 4, Line 65

"Pressure" should read -- pressure --

Column 5, Line 25

"S-3)," should read -- (S-3),--

Column 7, Line 30

"as phosphorus" should read -- as a phosphorus --

Column 8, Line 33

"as phosphorus" should read -- as a phosphorus --.

Signed and Sealed this

Thirteenth Day of August, 1991

*Attest:*

HARRY F. MANBECK, JR.

*Attesting Officer*

*Commissioner of Patents and Trademarks*